US007806174B2

(12) United States Patent
Khomynets

(10) Patent No.: US 7,806,174 B2
(45) Date of Patent: Oct. 5, 2010

(54) WELL JET DEVICE

(76) Inventor: Zinoviy Dmitrievich Khomynets, kv.4, d.46, Zeleny pr-t, Moscow (RU) 111396

( * ) Notice: Subject to any disclaimer, the term of this patent is extended or adjusted under 35 U.S.C. 154(b) by 0 days.

(21) Appl. No.: 12/528,608

(22) PCT Filed: Jan. 10, 2008

(86) PCT No.: PCT/RU2008/000006

§ 371 (c)(1),
(2), (4) Date: Aug. 25, 2009

(87) PCT Pub. No.: WO2008/127148

PCT Pub. Date: Oct. 23, 2008

(65) Prior Publication Data

US 2010/0032152 A1 Feb. 11, 2010

(30) Foreign Application Priority Data

Apr. 12, 2007 (RU) ..... 2007113620

(51) Int. Cl.
*E21B 33/00* (2006.01)
*F04F 5/00* (2006.01)

(52) U.S. Cl. ..... 166/68; 166/101; 166/250.01; 166/105; 166/372; 417/172

(58) Field of Classification Search ..... 166/68, 166/101, 250.01, 105, 372; 417/172
See application file for complete search history.

(56) References Cited

U.S. PATENT DOCUMENTS

2004/0071557 A1* 4/2004 Khomynets ..... 417/172

FOREIGN PATENT DOCUMENTS

| | | |
|---|---|---|
| RU | 2059891 C1 | 5/1996 |
| RU | 2160364 C1 | 12/2000 |
| RU | 2188970 C1 | 9/2002 |
| WO | 02/081928 | 10/2002 |

* cited by examiner

*Primary Examiner*—David J Bagnell
*Assistant Examiner*—Yong-Suk Ro
(74) *Attorney, Agent, or Firm*—patenttm.us

(57) ABSTRACT

A jet pump mounted on a pipe string and a packer, and a through channel with a sealing unit having a logging cable channel is in the pump body. A check valve is in a channel, for supplying a medium pumped out from a well, at the input thereof in the lower body. A guiding bush with a movable rod, arranged parallel to the logging cable, is fixed to the body under the valve. The top of the rod is positioned under the check valve closing element and a fork, over which the logging cable passes, fastens to the lower end of the rod. The closing element can be pressed out from a seat and brought into contact with the fork while a downhole instrument is lifted. The invention extends functionality by isolating pipe string spaces above and under the jet pump when the instrument is below the pump.

1 Claim, 3 Drawing Sheets

WELL JET DEVICE

FIELD OF THE INVENTION

This invention relates to pump engineering, primarily to well jet devices used for producing oil from wells.

DESCRIPTION OF RELATED ART

A well jet device is known, which comprises a jet pump installed on a flow string in a well and a geophysical instrument arranged in the flow string below the jet pump (see, RU 2059891 C1).

The known device enables pumping various produced fluids, e.g., oil, from wells, while simultaneously treating both a produced fluid and the formation near-well area. However, the known device provides for delivering a working fluid into the nozzle of the well jet device through a pipe string, and in some cases this narrows its field of application.

A well jet device, which is the closest to this invention as to its technical essence and effect, comprises: a packer; a pipe string with a support in which overflow windows are made and on which a jet pump is installed, where a channel for delivering an active fluid to the jet pump nozzle, a channel for delivering a pumped-out fluid to the jet pump and a channel for removing a fluid mixture from the jet pump are made in the body of the jet pump, and a through channel with a seat for mounting a sealing unit are made in the said body above the channel for delivering a pumped out fluid and in communication with the latter, the sealing unit is provided with an axial channel and has an axial channel used for passing, through it and through the channel for delivering a pumped out fluid, a logging cable for arranging downhole instruments and equipment, which may be moved along the borehole when the jet pump is or is not operated, on it in a well and below the jet pump; the channel for delivering an active fluid is connected to the overflow windows and, through the latter, to annular space surrounding the pipe string; and the channel for removing a fluid mixture from the jet pump is connected to the piping inner cavity above the jet pump (see, RU 2188970 C1).

The known well jet device enables conducting various process operations in a well at a level below the installed jet pump, including cases of differential pressures above and below the sealing unit. But this well jet device does not enable using its capabilities in full, which is connected with the impossibility of separating space in the pipe string above and below the jet pump when the jet pump is shut down, thus reducing a volume of works on studying producing formations.

SUMMARY OF THE INVENTION

The objective of this invention is to provide a well jet device with the possibility of separating the inner space of a pipe string above and below a jet pump when a bottomhole device is under the jet pump.

The technical effect obtained from using the proposed well jet device consists in expanding the device functionality.

The stated objective is achieved with obtaining the above technical effect due to the fact that the proposed well jet device comprises a packer, a pipe string with a support in which overflow windows and a seat for mounting a jet pump are made, an annular shoulder is made on the jet pump body, the said shoulder is intended for installing onto a seat in the pipe string support, and the said body is provided with a channel for delivering an active fluid into the jet pump nozzle, a channel for delivering a pumped out fluid into the jet pump, a channel for removing a fluid mixture from the jet pump and a through channel having a sealing unit installed in its upper part, the through channel going in parallel to the channel for delivering a pumped out fluid, and an axial channel is made in the sealing unit, the axial channel being used for passing a logging cable intended for connecting a downhole instrument, e.g., for ultrasonic treatment of producing formations, below the jet pump, which may be moved along the borehole when the jet pump is or is not operated. The channel for delivering an active fluid into the jet pump nozzle is connected to the overflow windows and, through the latter, to annular space surrounding the pipe string. A mixing chamber with a diffuser is arranged in line with the nozzle, and the diffuser is connected to the piping inner cavity above the jet pump on its side where a fluid mixture exits through the channel for removing a fluid mixture. A check valve is installed in the channel for delivering a pumped out fluid on its input side on the lower part of the jet pump body, and a guiding bush with an axially movable rod which is arranged therein in parallel to the logging cable is installed below the check valve, the upper end of the rod being positioned under the closing element of the check valve, and a fork, over which the logging cable is passed, is attached to the lower end of the rod. The rod is installed so that it may act on the closing element of the check valve and push the closing element off the seat when a downhole instrument is lifted up and contacts the rod fork.

An analysis of well jet device operation has shown that there is the possibility of expanding the well jet device functionality by enlarging a range of works that may be carried out in a well without lifting the jet pump to the surface and mounting additional equipment onto the jet pump. In particular, it is possible to record formation pressure recovery curves for the under-packer space as well as determine well flow rate when the jet pump is or is not operated. These works may be carried out due to the fact that the through channel having the sealing unit installed in its upper part is made parallel to the channel for delivering a pumped-out fluid, and a check valve is installed in the channel for delivering a pumped out fluid on its input side on the lower part of the jet pump body, and a guiding bush with an axially movable rod which is arranged therein in parallel to the logging cable is installed below the check valve, the upper end of the rod being positioned under the closing element of the check valve, and a fork, over which the logging cable is passed, being attached to the lower end of the rod, and the rod being installed so that it may act on the closing element of the check valve and push the closing element from the seat when a downhole instrument is lifted up and contacts the rod fork. Thus, the possibility of creating differential pressure drawdown to producing formations in a well is ensured, and then it is possible to isolate the well space below the jet pump and record a formation pressure recovery curve with the use of a downhole instrument. Such a formation pressure recovery curve may be recorded at various values of differential pressure drawdown to a producing formation. By creating a pulse differential pressure drawdown to a producing formation and simultaneously acting on the latter by, e.g., ultrasonic fields generated by a downhole instrument, it is possible to carry out works on intensifying an inflow from producing formations.

DESCRIPTION OF THE PREFERRED EMBODIMENT

Figure 1:
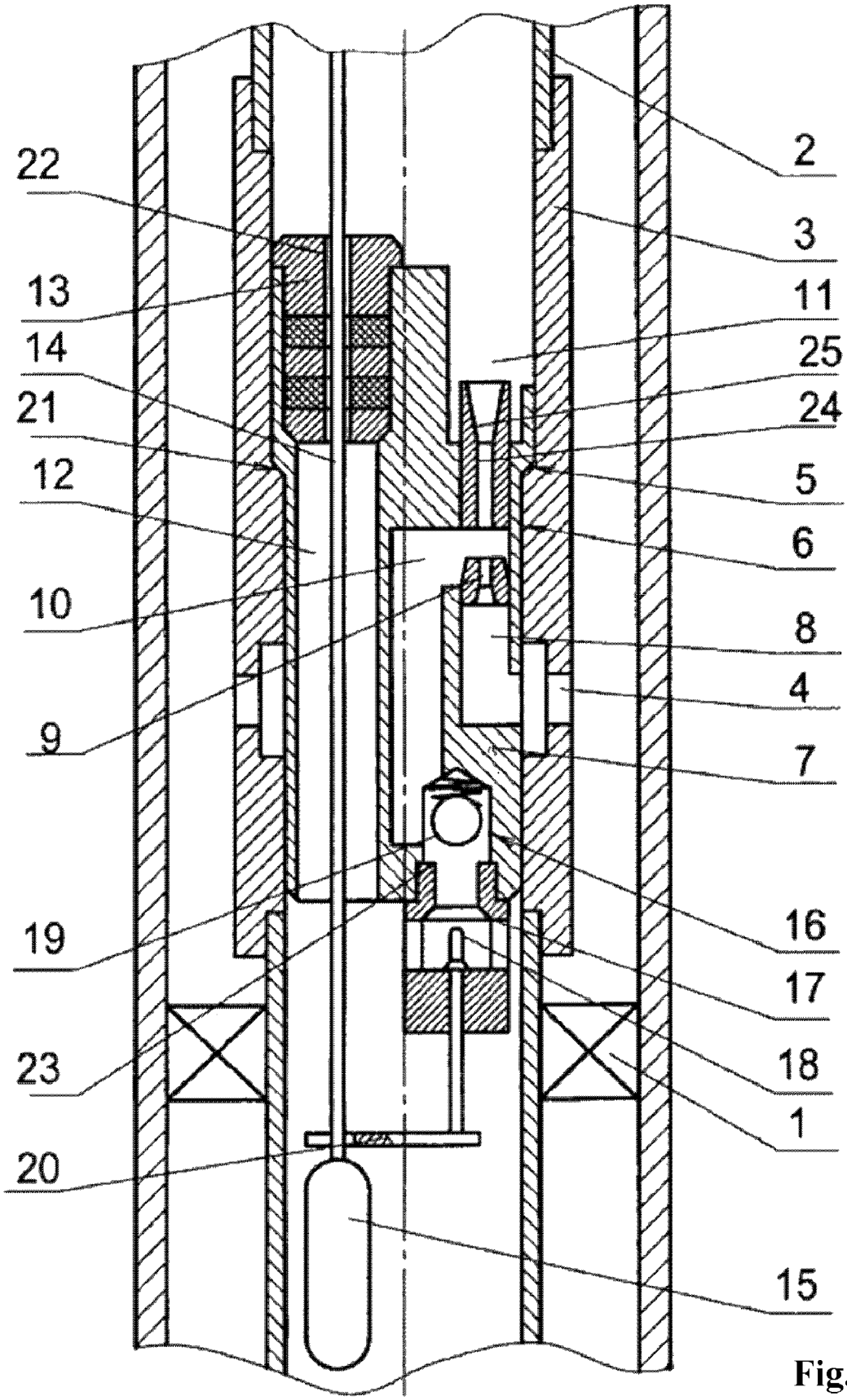
FIG. 1 shows a longitudinal section of the proposed well jet device with the jet pump in operation.
Figure 2:
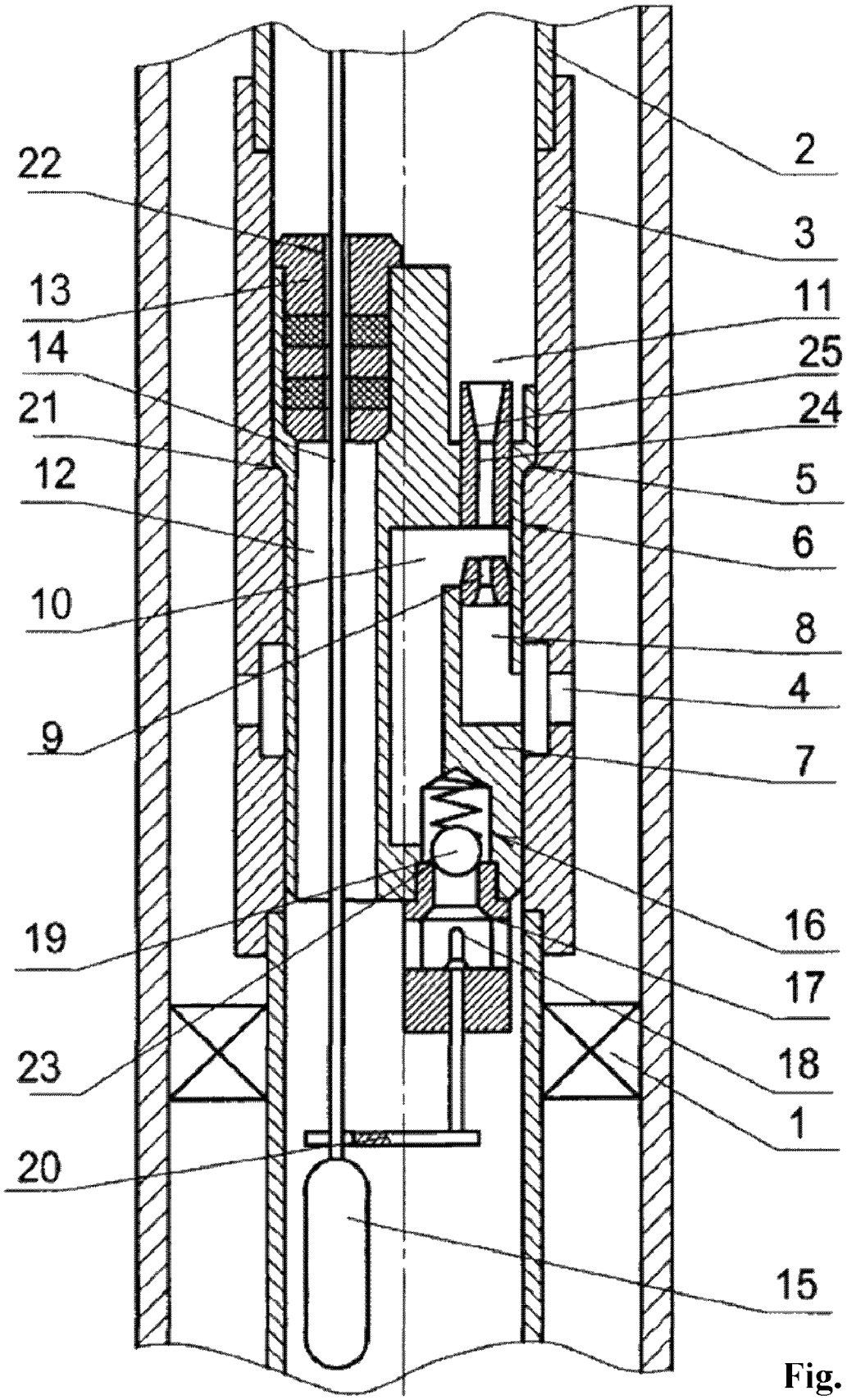
FIG. 2 shows a longitudinal section of the proposed well jet device with the jet pump shut down and during recording of a pressure recovery curve.
Figure 3:
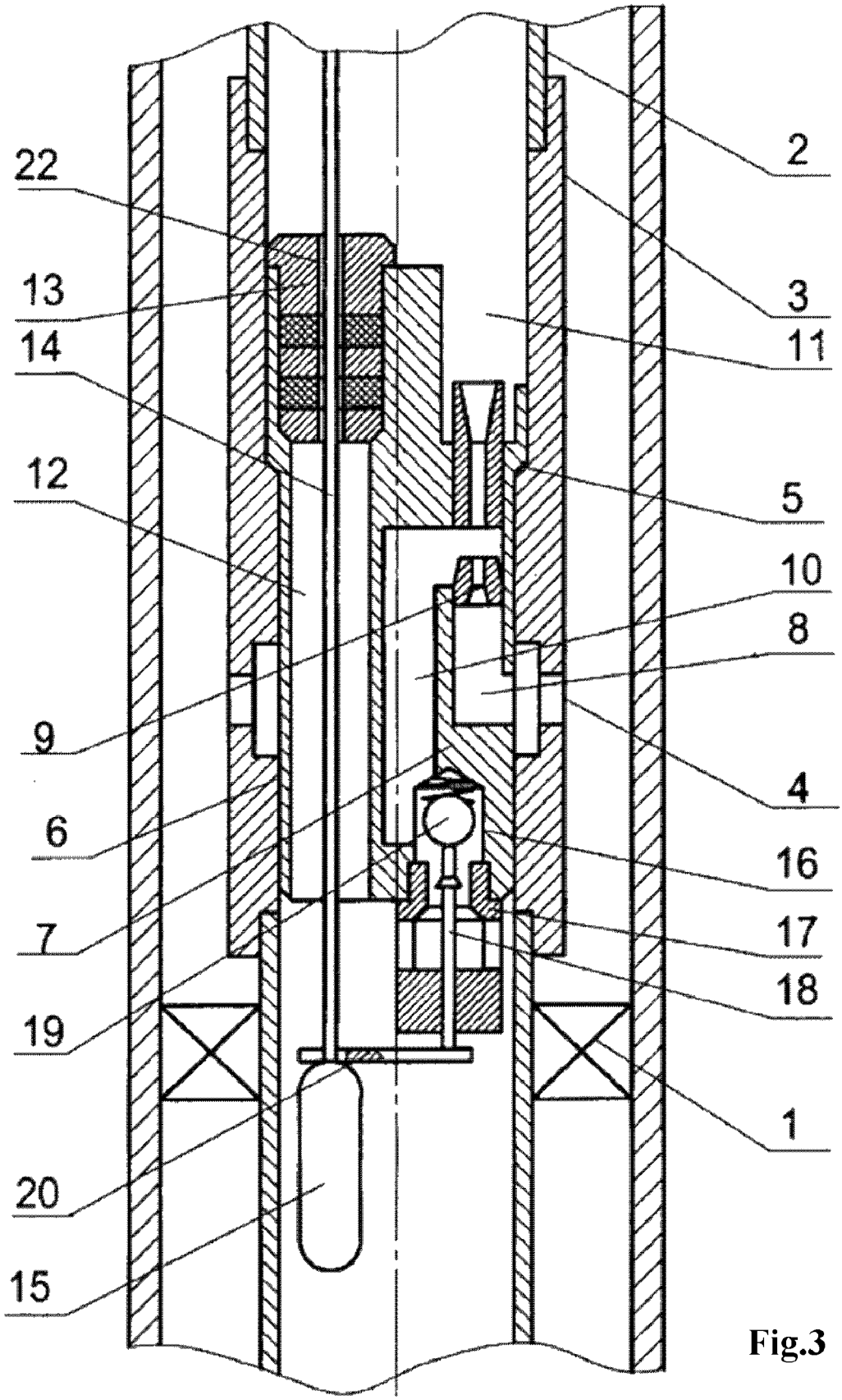
FIG. 3 shows a longitudinal section of the proposed well jet pump with the check valve closing element pushed off.

The proposed well jet device comprises a packer 1, a pipe string 2 with a support 3 where overflow windows 4 and a seat 5 for mounting a jet pump 6 are made. A shoulder 21, which is intended to be installed onto the mounting seat 5 in the support 3 of the pipe string 2, is made on the body 7 of the jet pump 6. The body 7 of the jet pump 6 is provided with a channel 8 for delivering an active fluid into a nozzle 9 of the jet pump 6, a channel 10 for delivering a pumped-out fluid into the jet pump 6, a channel 11 for removing a fluid mixture from the jet pump 6 and a through channel 12 with a sealing unit 13 in its upper part, which is made in parallel to the channel 10 for delivering a pumped-out fluid. The sealing unit 13 is provided with an axial channel 22 capable of receiving a logging cable 14 used for installing thereon a downhole instrument 15, e.g., for ultrasonic treatment of producing formations and/or determining physical parameters, for example a flow rate of a pumped-out fluid, in particular oil. The downhole instrument 15 is arranged so that it can be moved along the well bore when the jet pump 6 is or is not operated. The channel 8 for delivering an active fluid into the nozzle 9 of the jet pump is in communication with the overflow windows 4 and, through the latter, with space surrounding the pipe string 2. A mixing chamber 24 with a diffuser 25 is in alignment with the nozzle 9. The diffuser 25 is connected through the channel 11 for removing a fluid mixture from the jet pump 6 to the inner cavity of the pipe string 2 above the jet pump 6. The channel 10 for delivering a pumped-out fluid on the input side in the lower part of the body 7 is provided with a check valve 16 and a guiding bush 17 is arranged below the check valve 16 on the body 7 of the jet pump 6 and is provided with a rod 18 installed in parallel to the logging cable 14 and capable of moving axially. The upper end of the rod 18 is positioned under the closing element 19 of the check valve 16. A fork 20, which is passed over the logging cable 14, is attached to the lower end of the rod 18. The rod 18 is installed so that it can act on the closing element 19 of the check valve 16 and push the closing element 19 off the seat 23 if the downhole instrument 15 is lifted and contacts the fork 20 attached to the rod 18.

The proposed well jet device can be operated as follows.

The pipe string 2 with the packer 1 and the support 3 is lowered into a well, and the packer 1 is positioned over a producing formation. Then, the packer 1 is transferred into its working condition, thus separating space surrounding the pipe string 2. The jet pump 6 with the sealing unit 13, which is installed in the through channel 12, and the downhole instrument 15, which is installed on the logging cable 14 below the body 7 of the jet pump 6, is lowered into the pipe string 2. The body 7 of the jet pump 6 is installed onto the mounting seat 5. A working fluid, e.g., water, a salt solution, oil, etc., is pumped into space surrounding the pipe string 2. The working fluid comes from the windows 4 and the channel 8 into the nozzle 9 of the jet pump 6. Within several seconds from the beginning of pumping the working fluid through the nozzle 9 a stable jet is formed at its output, and, while exiting the nozzle 9, draws a surrounding medium into the mixing chamber 24, which results in lowering pressure first in the channel 10 for delivering a pumped-out fluid and then also in the well under-packer space, thus lowering pressure in the under-packer space. The value, for which pressure is lowered, depends on a velocity at which a working fluid goes through the nozzle 9, and such a velocity, in its turn, depends on a pressure of delivering such a working fluid through the well annular space above the packer 1. As a result, a formation fluid comes via the pipe string 2, through the check valve 16 and the channel 10 for delivering a pumped-out fluid, into the mixing chamber 24 and the diffuser 25 where it is mixed with the working fluid, and a fluid mixture comes from the well to the surface via the pipe string 2 due to the working fluid energy. During pumping out a formation fluid the downhole instrument 15, as installed on the cable 14, is used for monitoring parameters of the formation fluid pumped out as well as for acting on the respective producing formation by physical fields, e.g., ultrasonic fields, for the purpose of intensifying an inflow from the producing formation. Depending on a particular task, it is possible to move the downhole instrument 15 along the well bore. Then, after a pressure drawdown on the producing formation is created, the jet pump 6 is stopped, and the downhole instrument is used for recording a formation pressure recovery curve for the under-packer space in the well. After a well study is completed and the producing formation is treated, the downhole instrument 15 is lifted on the logging cable 14, and the instrument 15 acts on the fork 20 and, through the latter, on the rod 18, thus causing its upward movement until it pushes the closing element 19 of the check valve 16 off the seat, which results in a fluid overflow from the above-packer space of the well through the channel 10 for delivering a pumped-out fluid. Thus, the fluid pressures above and below the jet pump 6 are equalized. Then, by using the logging cable 14, the jet pump is removed from the well, and works may be carried out on transferring the well into the operation mode.

INDUSTRIAL APPLICABILITY

The proposed invention may be used in testing, completing and operating oil and gas-condensate wells, as well as during their major repairs.

What is claimed is:

1. A well jet device comprising: a packer, a pipe string with a support in which overflow windows and a seat for mounting a jet pump are made; said jet pump has a body provided with an annular shoulder, said shoulder being intended for installing onto the seat in the pipe string support, and said body being provided with a channel for delivering an active fluid into the jet pump nozzle, a channel for delivering a pumped out fluid into the jet pump, a channel for removing a fluid mixture from the jet pump and a through channel having a sealing unit installed in its upper part, said through channel going in parallel to the channel for delivering a pumped out fluid, and an axial channel being made in the sealing unit, said axial channel being used for passing a logging cable intended for connecting a downhole instrument, below the jet pump, which may be moved along the borehole when the jet pump is or is not operated; the channel for delivering an active fluid into the jet pump nozzle is connected to the overflow windows and, through the latter, to annular space surrounding the pipe string; a mixing chamber with a diffuser is arranged in line with the nozzle, and the diffuser is connected to the piping inner cavity above the jet pump on its side where a fluid mixture exits through the channel for removing a fluid mixture; a check valve is installed in the channel for delivering a pumped out fluid on its input side on the lower part of the jet pump body, and a guiding bush with an axially movable rod which is arranged therein in parallel to the logging cable is installed below the check valve, the upper end of the rod being positioned under the closing element of the check valve, and a fork, over which the logging cable is passed, being attached to the lower end of the rod; the rod is installed so that it may act on the closing element of the check valve and push the closing element off the seat when the downhole instrument is lifted up and contacts the rod fork.

* * * * *